US005213206A

United States Patent [19]

Beck et al.

[11] Patent Number: 5,213,206

[45] Date of Patent: May 25, 1993

[54] CIRCUIT BREAKER WITH POSITIVE ON/OFF INTERLOCK

[75] Inventors: Henry R. Beck, Coraopolis; Charles W. Pipich, Monroeville, both of Pa.

[73] Assignee: Westinghouse Electric Corp., Pittsburgh, Pa.

[21] Appl. No.: 706,713

[22] Filed: May 29, 1991

[51] Int. Cl.[5] ..... H01H 5/25

[52] U.S. Cl. ..... 200/401; 200/327; 200/DIG. 42; 335/166; 335/168; 335/24

[58] Field of Search ..... 200/401, 318, 323, 324, 200/325, 326, 327, 43.16, DIG. 42; 337/47, 48, 49, 50, 70; 335/166, 167, 168, 169, 170, 171, 172, 173, 174, 175, 9, 10, 22, 23, 24

[56] References Cited

U.S. PATENT DOCUMENTS

| | | | |
|---|---|---|---|
| 3,525,959 | 8/1970 | Ellsworth et al. | 335/166 |
| 3,605,052 | 9/1971 | Dimond | 355/166 |
| 3,614,685 | 10/1971 | Ellsworth et al. | 335/166 |
| 3,849,747 | 11/1974 | Mrenna et al. | 335/166 |
| 3,849,751 | 11/1974 | Link et al. | 200/401 X |
| 4,129,762 | 12/1978 | Bruchet | 200/401 |
| 4,165,453 | 8/1979 | Hennemann | 200/401 |
| 4,368,444 | 1/1983 | Preuss et al. | 359/169 X |
| 4,546,224 | 10/1985 | Mostosi | 200/401 |
| 4,594,491 | 6/1986 | Leone et al. | 200/401 X |
| 4,630,019 | 12/1986 | Maier et al. | 337/70 |
| 4,679,016 | 7/1987 | Ciarcia et al. | 335/9 |
| 4,713,639 | 12/1987 | Grunert et al. | 335/175 X |
| 4,951,019 | 8/1990 | Gula | 200/401 X |

*Primary Examiner*—Henry J. Recla
*Assistant Examiner*—Glenn T. Barrett
*Attorney, Agent, or Firm*—M. J. Moran

[57] ABSTRACT

A pair of lock links straddling and pivoted on the same pin as the latchable cradle of a circuit breaker follow the toggle device of the breaker either by riding on the toggle knee pin or through a pin which bears against the edges of the toggle arms. The lock links have extensions which engage the handle yoke to prevent the handle from being moved to the off position when the circuit breaker contacts are welded closed causing the toggle device to remain erected.

4 Claims, 7 Drawing Sheets

CIRCUIT BREAKER WITH POSITIVE ON/OFF INTERLOCK

CROSS REFERENCES TO RELATED APPLICATION

Commonly owned, U.S. Patent Application entitled "Circuit Breaker with Welded Contacts" filed concurrently herewith in the names of Yu Wei Chou and Henry K. Pruszynski, Ser. No. 07/706,714 now U.S. Pat. No. 5,184,717.

Commonly owned, U.S. Patent Application entitled "Circuit Breaker with Interlock for Welded Contacts" filed concurrently herewith in the names of Charles W. Pipich and William E. Beatty, Ser. No. 07/706,720 now U.S. Pat. No. 5,165,532. Commonly owned, U.S. patent application Ser. No. 502,812, U.S. Pat. No. 5,142,112, entitled "Circuit Breaker Positive Interlock" filed Apr. 3, 1990, by D. A. Parks, T. A. Whitaker and Y. W. Chow.

BACKGROUND OF THE INVENTION

1. Field of the Invention

This invention relates to a circuit breaker in which the handle is blocked from movement to the off position when the contacts are welded closed.

2. Background Information

A common type of circuit breaker has a fixed electrical contact, and a movable electrical contact mounted on a movable contact arm. The contacts are closed and opened by rotating a handle between an on and off position, respectively. A latchable cradle connected to the movable contact arm by a spring operated toggle device is held in a latched position by a trip device. In response to predetermined overload conditions in the circuit breaker, the trip mechanism unlatches the latchable cradle and the spring operated toggle device rotates the movable contact arm to open the contacts. When the circuit breaker is tripped in this manner, the spring operated toggle device also moves the handle to a trip position intermediate the on and off positions. Thus, the handle provides a visual indication of the state of the circuit breaker. The circuit breaker is reset by moving the handle slightly past the off position to relatch the latchable cradle, and then to the on position to reclose the contacts.

It is possible under some overload conditions for the contacts of a circuit breaker to become welded closed. Under these circumstances, the trip device of the circuit breaker described above can respond to the overload condition by unlatching the latchable cradle. If the weld is of sufficient strength, the contact arm cannot be rotated and the contacts remain closed. However, it is possible to rotate the handle to the off position to relatch the cradle.

Several remedies for this condition have been proposed. In U.S. Pat. No. 3,525,959, the cradle is latched by a latch member which is engaged by the trip mechanism. To reset a tripped circuit breaker of this type, the knee pivot of the toggle which forms part of a spring loaded operating mechanism which trips the breaker, engages the latch member as the handle is moved to the off position to relatch the cradle. When the breaker is tripped, but the contacts are welded closed, the toggle remains erected and does not engage the latch member to relatch the cradle when the handle is moved to the off position. Thus, the cradle cannot be reset and the springs of the actuating mechanism maintain the handle in the on position when released indicating the true condition of the contacts.

In one embodiment of the circuit breaker of U.S. Pat. No. 3,614,685, a blocking member on the movable contact arm structure prevents the cradle from moving to a position at which it can be relatched by the trip mechanism when the handle is moved to the off position following a trip with the contacts welded closed. In another embodiment of this circuit breaker, a latch on the cradle engages a stationary part to prevent rotation of the cradle to the relatched position following a trip with the contacts welded closed. In both embodiments, the springs bias the handle to the on position under these conditions to indicate the real position of the welded contacts.

In U.S. Pat. No. 4,630,019, a handle yoke latch prevents rotation of the handle to the reset position if the contacts are welded closed. When the contacts are not welded closed, the movable contact arm structure rotates the handle yoke latch out of the path of the handle yoke to permit a tripped circuit breaker to be reset.

While the circuit breakers in U.S. Pat. Nos. 3,525,959 and 3,614,685 prevent relatching of the cradle following a trip with the contacts welded closed, and bias the handle to the on position to show that the contacts remain closed, the handle can still be moved to the off position. In some applications, circuit breakers are operated remotely by a motor operator. If the handle can be moved to the off position even though biased to the on position, the motor operator could hold the handle in the off position providing an indication that the contacts of the circuit breaker were open when in fact they were welded closed. In addition, in some installations, the circuit breaker is mounted in a cabinet with the handle mechanism extending through the cabinet door wall for external operation. It is possible for such a handle mechanism to have sufficient friction that the handle could remain in the off position despite the spring bias in the circuit breaker to the open position when the contacts were welded closed. In some installations, a hasp lock is provided to lock the circuit breaker in the off position. If the handle can be moved to the off position with the contacts welded closed, it is possible for the handle to be locked in the off position when in fact the contacts are welded closed. Obviously, this is not a satisfactory condition.

U.S. Pat. No. 3,849,747 discloses a miniature circuit breaker with a latchable cradle which is connected by a spring to a movable contact arm which in turn is connected to a handle. Since the handle is connected directly to the contact arm, it cannot be moved to the off position if the contacts are welded closed, and correspondingly, the handle cannot be relatched.

Commonly owned U.S. patent application Ser. No. 07/511,700, entitled "Circuit Breaker with Positive Indication of Welded Contacts" and filed on Apr. 20, 1990 discloses a circuit breaker in which an interference device in the form of a pin on a cross-bar joining the movable contact arm associated with each phase of the circuit breaker engages the operating member incorporating the handle to prevent rotation of the handle to the off position when the contacts are welded closed.

It is the primary object of the present invention to provide a circuit breaker with an improved arrangement for preventing movement of the operating handle to the off position when the contacts are welded closed.

SUMMARY OF THE INVENTION

This and other objects are realized by the invention which is directed to an electrical circuit breaker having a fixed contact, a movable contact carried by a movable contact arm structure, and an operating mechanism including a latchable cradle held in a latched position by a trip device which unlatches the cradle in response to predetermined current overload conditions. A toggle mechanism connected to the latchable cradle and movable contact arm structure is movable between an erected position which moves the movable contact arm structure to the closed position and a collapsed position which moves the contact arm structure to the open position. A spring member is connected between the toggle member and an operating member incorporating the handle. The spring member biases the toggle device to the erected position to hold the contact arm structure in the closed position with the latchable cradle latched and the handle in an on position. When the handle is moved to an off position, the spring member biases the toggle device to the collapsed position to move the contact arm structure to the off position. When the trip device unlatches the cradle in response to an overload condition, the spring member collapses the toggle device to open the contacts and moves the handle to the intermediate, tripped position. An interlock member engages the toggle device to block movement of the handle to the off position when the contacts are welded closed and the toggle device remains erected.

More particularly, the interlock member is a pivoted member which is engaged by the knee pin of the toggle device or an edge of a toggle arm. When the toggle is erected, the pivoted member is pivoted into a position where hook-like projections block movement of the handle to the off position. If the contacts are not welded closed, initial movement of the handle out of the on position or tripping of the circuit breaker results in collapse of the toggle device thereby allowing the pivoted member to move out of the path of the handle which then moves to the off or tripped position. However, when the contacts are welded closed so that the toggle device remains erected, the pivot member remains pivoted into position where it blocks movement of the handle to the off position In the preferred embodiment of the invention, the pivot member comprises a pair of lock links one on each side of the cradle and pivoted about the same pivot pin as the cradle.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

The drawings show a new and improved circuit breaker 1 incorporating the invention. The circuit breaker 1 is of the type described in U.S. Pat. No. 4,630,019 which is hereby incorporated by reference for providing full details of the basic circuit breaker.

While the invention is shown as applied to a three phase circuit breaker, it will be evident to those skilled in the art that the invention has equal applicability to single phase or other multiphase circuit breakers, including three-phase circuit breakers with a neutral line.

Figure 1:
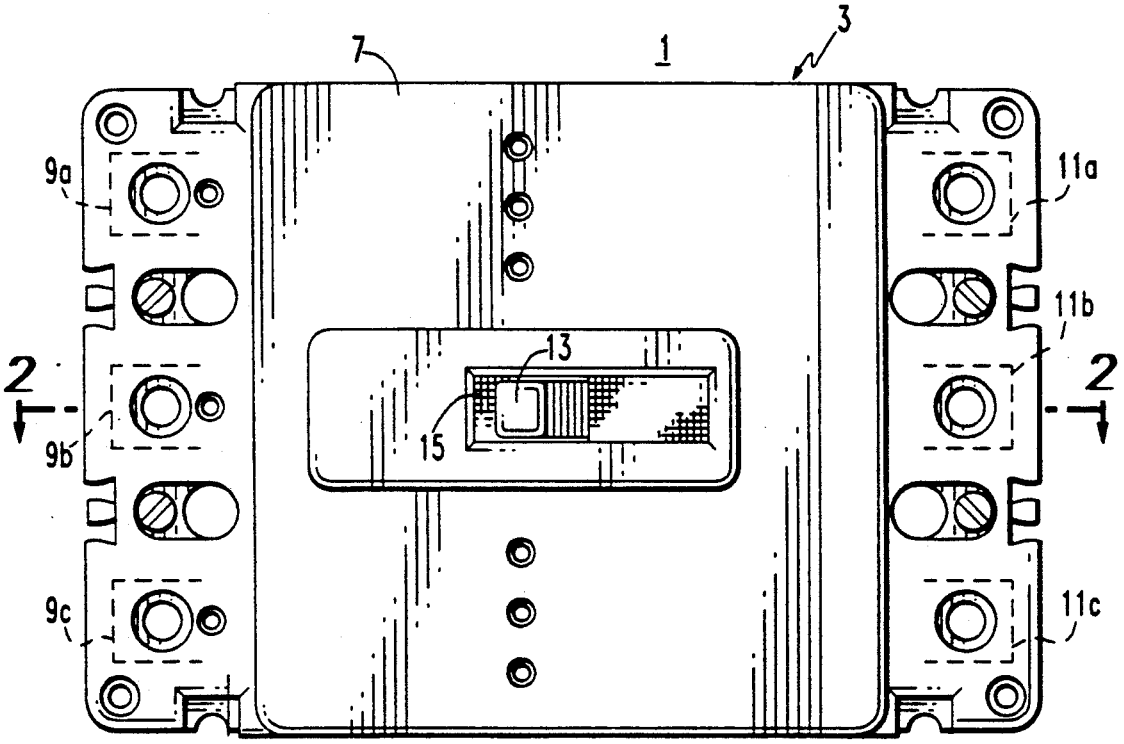
FIG. 1 is a plan view of a circuit breaker incorporating the invention.

As shown in FIG. 1, the circuit breaker 1 includes a molded, electrically insulating enclosure 3 comprising a base 5 (see FIG. 2) and a removable cover 7. A set of input terminals *9a*, *9b* and *9c*, one for each pole, and a set of output terminals *11a*, *11b* and *11c*, are provided to connect the circuit breaker 1 into, in this instance, a three phase electrical system to be protected by the circuit breaker. A handle 13 for manually opening and closing the circuit breaker, and for indicating the state of circuit breaker extends through an opening 15 in the cover 7.

Figure 2:
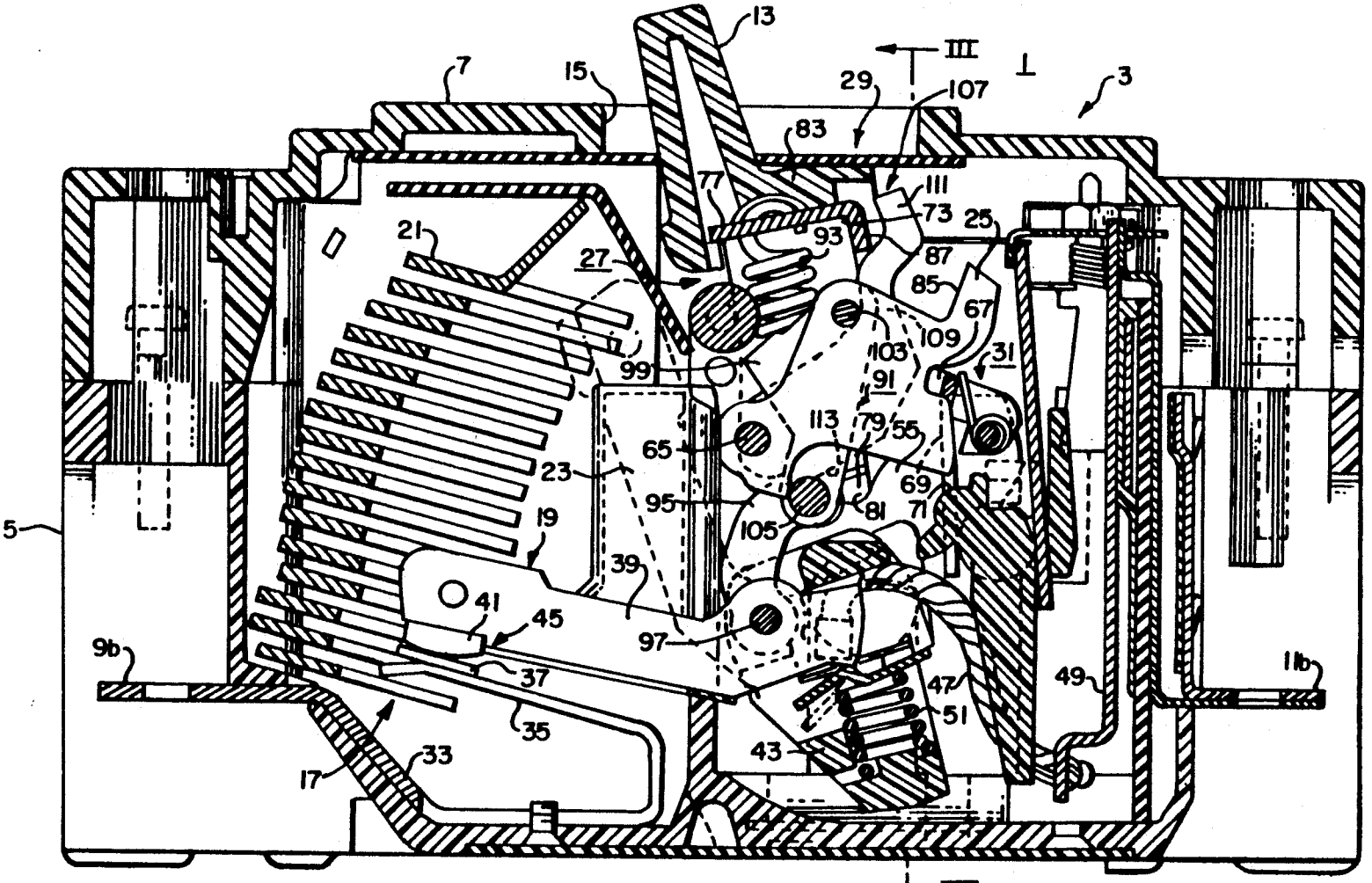
FIG. 2 is a longitudinal vertical section taken along the line II—II of the circuit breaker of FIG. 1 shown in the on or closed position.

Turning to FIG. 2, which is a cross section through the center pole, circuit breaker 1 includes for each pole a lower contact structure 17, a movable contact structure 19, an arc chute 21 to aid in extinguishing the electrical arc created by the interrupting current through the pole, and a slot motor 23 to aid in accelerating interruption of the current. The major components of the circuit breaker 1 also include a common latchable cradle 25, a spring operated actuating mechanism 27, an operating member 29 and a trip mechanism 31 which is responsive to predetermined overcurrent conditions in each pole.

The lower contact structure 17 includes a stationary conducting member 33, the outer end of which constitutes the input terminal 9 for the respective pole. The stationary conducting member 33 has a cantilevered inner end 35 which carries a fixed electrical contact 37.

The movable contact structure 19 includes a movable contact arm 39 carrying at its outer end a movable electrical contact 41. Each of the movable contact arms 39 is mounted on a common transverse cross-bar 43 for simultaneous rotational movement between a closed position shown in FIG. 2 and an open position shown in FIG. 4. The fixed electrical contact 37 and the movable electrical contact 41 form a set of contacts 45 which are closed to complete an electrical circuit through the circuit breaker when the contact arm is in the closed position, and to interrupt current through the respective pole of the circuit breaker when the contact arm is in the open position. A flexible conductor 47 is connected between the movable contact arm 39 and a bimetal 49 which in turn is connected to the respective output terminal 11.

The movable contact arms 39 for the three poles are pivotally connected to the common cross-bar 43 and are biased by compression springs 51 mounted in recesses within the cross-bar. These compression springs 51 insure that the movable contact arms 39 move in unison with the cross-bar 43 and apply a predetermined closing force to the set of contacts 45. They also permit the electrical contacts 45 to rapidly separate when blown open by a high level short circuit without waiting for the operating mechanism to sequence.

Figure 3:
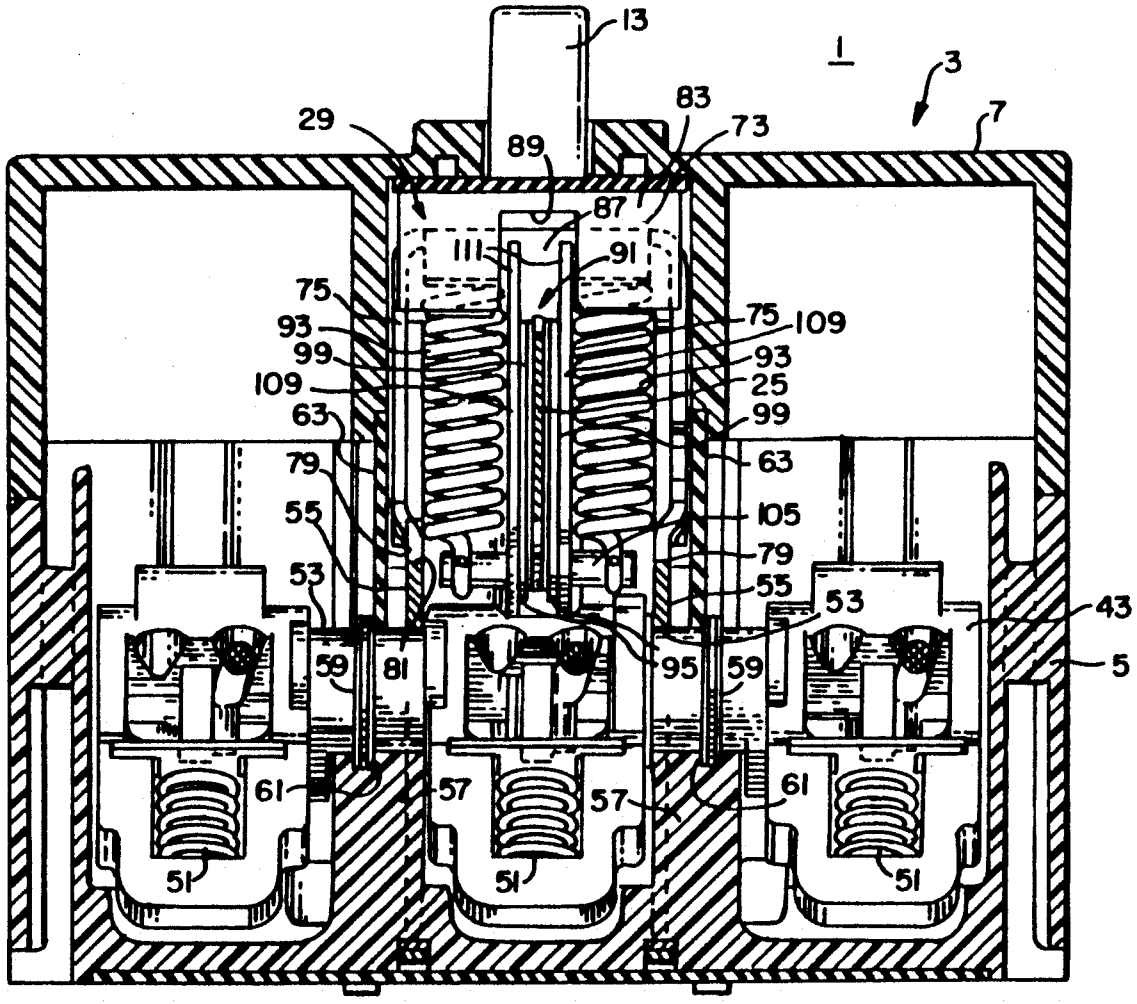
FIG. 3 is a transverse vertical section of the circuit breaker of FIG. 2 taken generally along the line III—III.

As best seen in FIG. 3, the common cross-bar 43 is journaled for rotation in apertures 53 in spaced apart side plates 55 secured in partitions 57 in the molded base 5 of the circuit breaker. Axial movement of the cross-bar is restrained by integral flanges 59 which are engaged by grooves 61 in the partitions 57. Insulating panels 63 electrically isolate the poles of the circuit breaker 1.

Referring again to FIG. 2, the latchable cradle 25 is mounted for rotation about one end by a cradle pin 65 supported by the side plates 55. The free end of the latchable cradle includes a slot or groove defining a latching surface 67. This latching surface 67 engages a slot 69 in a latch plate 71 which forms part of the trip mechanism 31.

The operating member 29 includes a U-shaped yoke 73 having a pair of spaced apart parallel arms 75 joined by a web 77. As is best seen in FIG. 3, arcuate free ends of tabs 79 inwardly offset from the lower ends of the operating member arms 75 are received in and rotate in arcuate recesses 81 in the side plates 55. The operating member 29 includes the handle 13 having an integrally molded base 83 which is secured to the yoke 73. The handle 13, and with it the yoke 73, are movable between the on position shown in FIG. 2 and an off position shown in FIG. 4. They are also positionable to a trip position shown in FIG. 5 which is intermediate the on and off positions. The cradle 25 includes a yoke contacting surface 85 configured to contact a flange 87 on the web 77 through a slot 89 in the molded base 83 on the handle 13. (See FIGS. 2 and 3.) The contact surface 85 on the cradle 25 contacts the flange 87 to position the handle to the tripped position when the trip mechanism releases the cradle. When the handle 13 is moved past the off position, the flange 87 contacts the surface 85 to rotate the cradle 25 for relatching.

The spring operated actuating mechanism 27 includes a toggle device 91 and a pair of helical tension springs 93. The toggle device 91 includes a pair of lower toggle arms 95 straddling the movable contact arm 39 of the center pole and pivotally connected thereto by a lower toggle pin 97. The toggle device 91 further includes a pair of upper toggle arms 99 straddling the latchable cradle 25 and having an upper toggle pin 103 extending through and connected to the cradle 25. The upper and lower pairs of toggle arms 99 and 95 are pivotally connected together by a toggle knee pin 105. The pair of helical tension springs 93 are stretched between the web 77 of the yoke 73 and the toggle knee pin 105 outside the upper toggle arms 99.

With the handle 13 in the on position, the line of action of the springs 93 is to the left of the upper toggle pin 103, as viewed in FIG. 2, to rotate the toggle knee pin 105 in the clockwise direction relative to pin 103. With the latching cradle 25 engaged by the intermediate latch plate 71, the lower toggle arms 95 are rotated in a counterclockwise direction relative to pin 97 to rotate the cross-bar 43, and therefore, each of the movable contact arms 39, in the counterclockwise direction to the closed position wherein the electrical contacts 45 are closed.

Upon the occurrence of predetermined overcurrent conditions in one of the poles of the circuit breaker 1, the trip device 31 (such as the device described in detail in U.S. Pat. No. 4,630,019) is operated to rotate the latching plate 71 out of engagement with the latching surface 67 on the latchable cradle 25. With the cradle 25 unlatched, the springs 93 acting through the toggle knee pin 105, upper toggle arms 99 and upper toggle pin 103, rapidly accelerate the latchable cradle 25 in the counterclockwise direction as viewed in FIG. 2. This shifts the line of action of the tension springs 93 behind the toggle pin 103 causing the toggle mechanism to collapse thereby raising the toggle knee pin 105, and through the lower toggle arms 95, the lower toggle pin 97. Raising of the lower toggle pin 97 rotates the cross-bar 43 in the clockwise direction thereby raising all of the movable contact arms 39 to simultaneously open the sets of contacts 45 for each pole of the circuit breaker. As this occurs, any electrical arc struck across the sets of contacts 45 are extinguished by the arc chutes 21. As the toggle device 91 breaks, with the upper toggle arms 99 rotating counterclockwise, and the lower toggle arms 95 rotating clockwise, the yoke 73 carrying the handle 13 is moved to the intermediate position shown in FIG. 5 by the rotating cradle 25 which contacts the flange 87 on the yoke. This positioning of the handle between the off and on positions provides a visual indication that the circuit breaker 1 has tripped.

Figure 4:
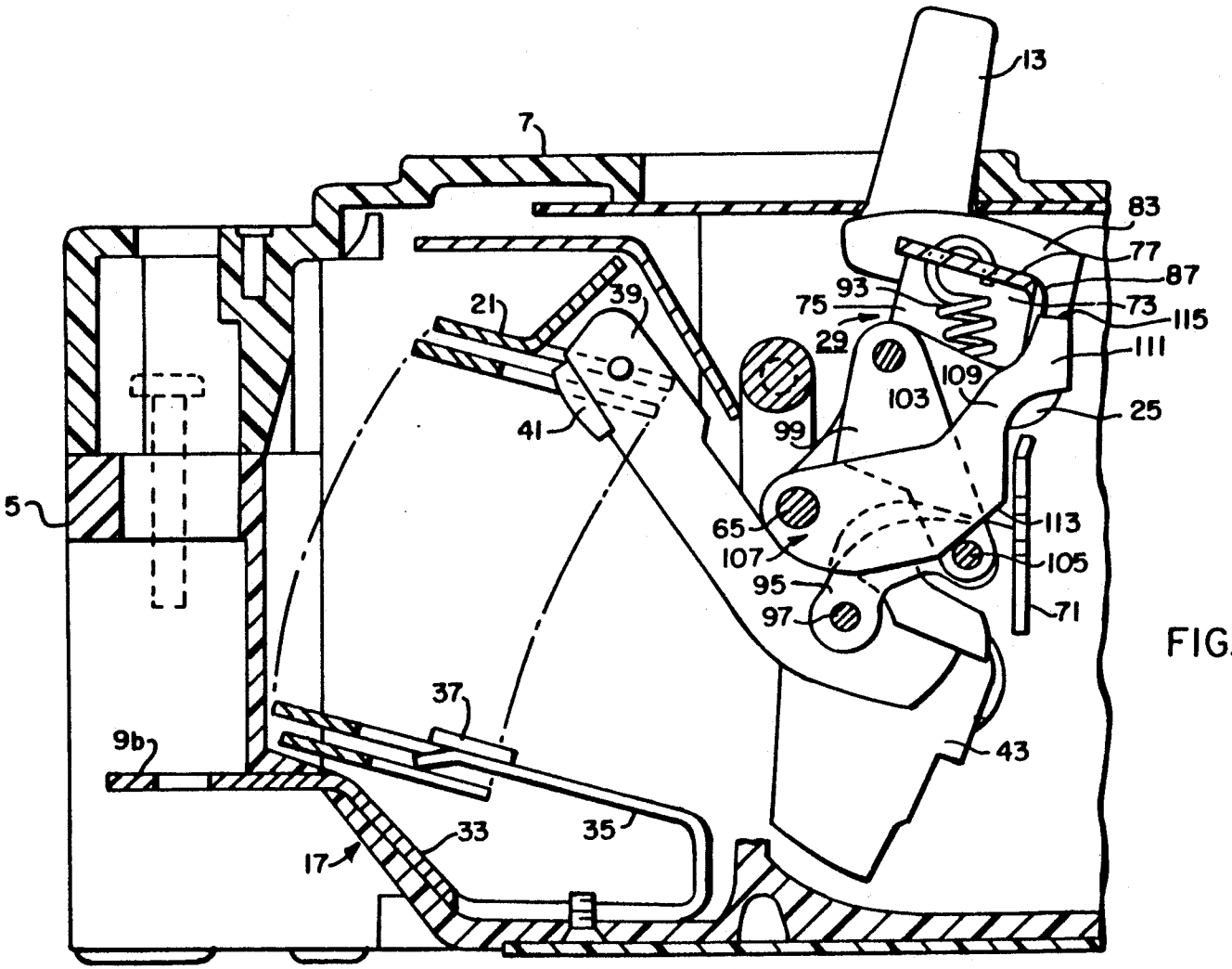
FIG. 4 is a fragmentary view similar to the view of FIG. 2 showing the circuit breaker in the normal open or off position.

To reset the circuit breaker the handle 13 is moved toward, and slightly past the off, or full clockwise position, as viewed in FIG. 4. As the handle is brought to this reset position, the flange 87 on the yoke 73 bears against the surface 85 on the latchable cradle 25 to rotate the cradle clockwise until the latching surface 67 engages the intermediate latch plate 71 of the trip mechanism 31. Movement of the handle to this position causes the line of action of the springs 93 to move to the right of the toggle pin 103 so that the handle remains in the off position.

To again close the circuit breaker, the handle 13 is moved from the off position shown in FIG. 4 to the on position shown in FIG. 2. When the line of action of the springs 93 passes to the left of the upper toggle pin 103, the toggle device 91 is erected and the cross-bar 43 is rotated counterclockwise to close the sets of electrical contacts 45 as previously described.

If the set of contacts 45 of any one of the poles of the circuit breaker 1 is welded closed, the associated contact arm 39, and therefore, the cross-bar 43 and the other movable contact arms 39, cannot be rotated. Thus, the contacts 45 for all of the poles remain closed. In the case of a trip, even though the latchable cradle 25 is released by the latch plate 71, the handle 13 remains in the on position because the toggle knee pin 105 is prevented from rising by the welded contacts, and hence, the toggle device remains erected. Without the present invention, however, it would still be possible to move the handle 13 to the off position although it would spring back to the on position when released since the line of action of the springs 93 could not be moved to the right of the upper toggle pin 105. As previously mentioned, however, this is not a satisfactory condition where the handle 13 is operated remotely by a motor driven operator or by a handle extension when a circuit breaker is mounted within an enclosure, or when the possibility of locking the handle in the off position using a hasp lock exists.

Figure 5:
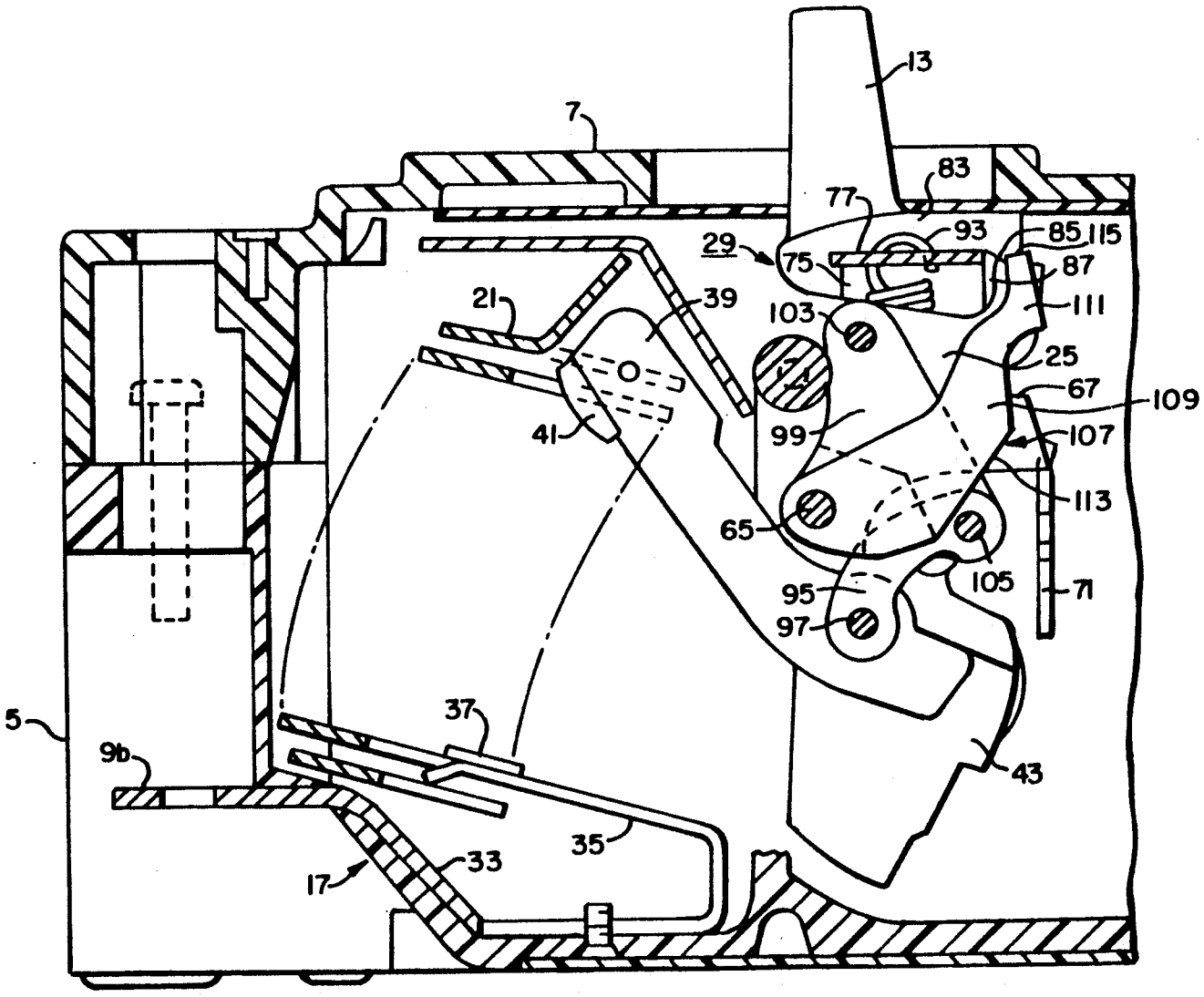
FIG. 5 is a fragmentary view similar to FIG. 2 showing the circuit breaker in the normal trip position.
Figure 6:
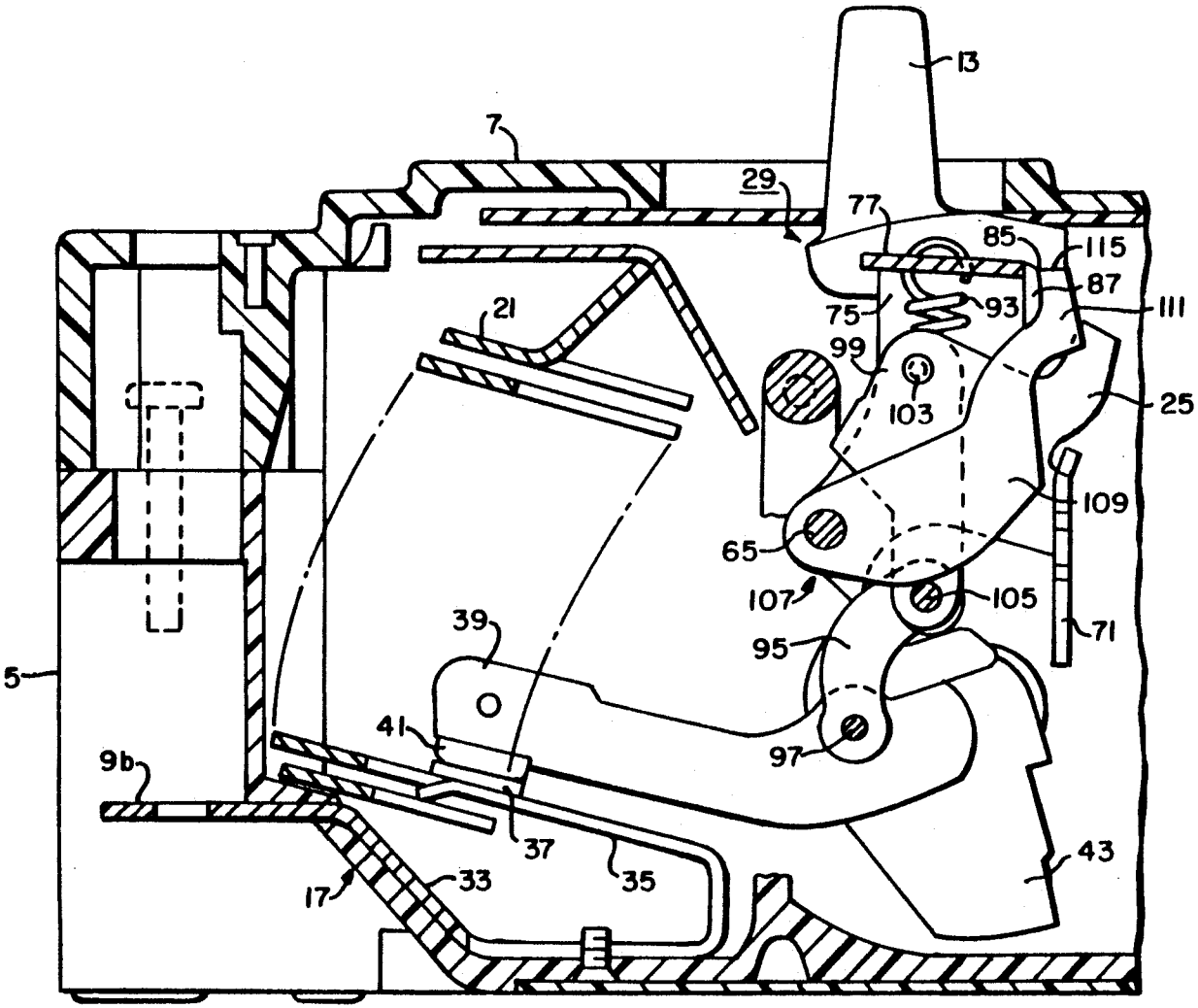
FIG. 6 is a fragmentary view similar to FIG. 2 showing the circuit breaker tripped with the contacts welded closed.

In accordance with the invention an interlock member 107 in the form of a pair of lock links 109 is pivotally mounted on the cradle pin 65 with one lock link on each side of the cradle 25 which is also pivoted on the pin 65. The lock links 109 are elongated and terminate in an upward extension 111. The lower edges of the lock links 109 are camming surfaces 113 which ride on the toggle spring pin 105 to sense the motion of this pin. The toggle spring pin 105 provides an indication of whether the contacts 45 are in the closed or open position. There is significant movement of the toggle spring pin 105 between its position when the contacts 45 are closed as shown in FIG. 2, and when the contacts are open. FIG. 4 illustrates the position of the toggle spring pin 105 when the contacts are open with the circuit breaker handle 13 in the off position. FIG. 5 illustrates the position of the toggle spring pin 105 with the circuit breaker tripped, and the handle 13 in a position intermediate the on and off positions to provide a visual indication that the circuit breaker is tripped. FIG. 6 illustrates operation of the invention when the breaker is tripped but the contacts are welded closed.

FIGS. 4 through 6 are similar to FIG. 2 but with only the parts shown which are relevant to the operation of the invention.

With the toggle device 91 erected as when the contacts 45 are closed as shown in FIG. 2, the lock links 109 are rotated upward into a position where the extensions 111 extend upward behind the flange 87 on the handle yoke 73. In normal operation, as when the handle is manually moved to the off position shown in FIG. 4, the toggle device 91 is collapsed as discussed above and the toggle spring pin 105 moves to the right as shown in FIGS. 2 and 4 so that the lock links 109 rotate out of the way of the handle yoke 73. Similarly, when the circuit breaker is tripped, and the toggle device collapses to open the contacts 45 as shown in FIG. 5, the toggle links again rotate out of the path of the handle yoke 73. As the handle is moved from the trip position shown in FIG. 5 to past the off position as shown in FIG. 4 to relatch the cradle 25, the additional movement of the toggle spring pin 105 to the right as shown in FIGS. 4 and 5 allows the lock links 109 to rotate ahead of the handle yoke 73.

However, when the contacts 45 of any of the poles of the circuit breaker 1 are welded closed, the cross bar 43 cannot rotate and the toggle device 91 remains erected. Even though the cradle 25 is unlatched and rotates counterclockwise as viewed in the drawings, the line of force of the tension springs 93 remains to the left of the pin 103 and hence the handle 13 stays in the on position providing a visual indication of the state of the contacts 45. If an attempt is made to reset the circuit breaker, either manually or by a power driven operator, the handle 13 can only be rotated to the position shown in FIG. 6, which is about three degrees past the toggle point. At this point, the contact surface 115 on the extensions 111 of the lock links 109 engage the flange 87 on the handle yoke 73. Since the lock links 109 are restrained from rotating out of the path of the handle yoke 73 by the toggle spring pin 105 which is held in the erected position by the welded contacts, further movement of the handle 13 towards the off position is mechanically blocked. If the handle 13 is released at this point, the springs 93 will return the handle to the on position to provide an indication that the contacts 45 remain closed.

Figure 7:
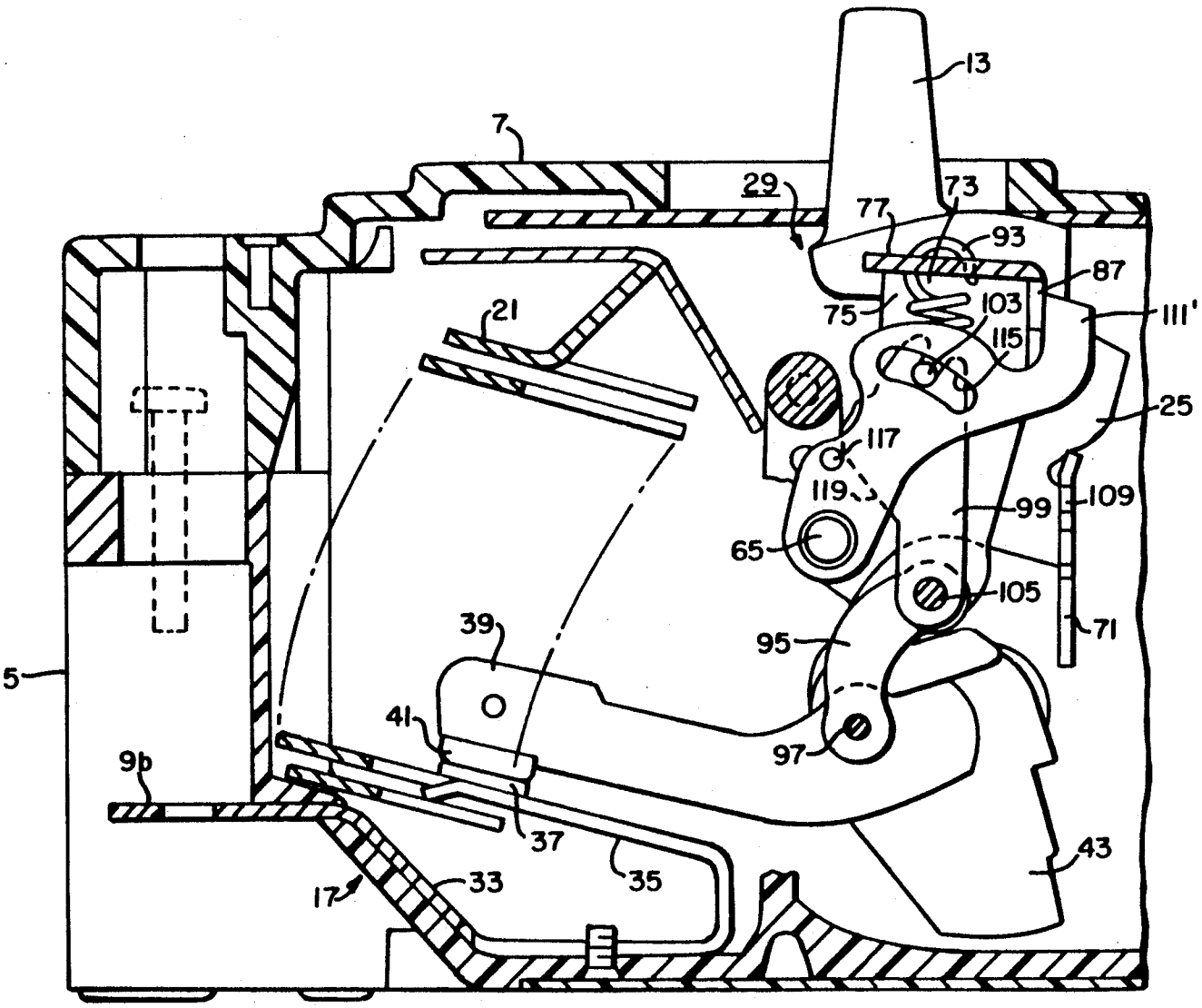
FIG. 7 is a fragmentary view of another embodiment of the invention showing the circuit breaker with the contacts welded closed and the handle in the positive off position.

FIG. 7 illustrates another embodiment of the invention. Parts which are the same as the parts in the first embodiment of the invention described above are given like reference characters. This embodiment of the invention incorporates a modified pair of lock links 109'. These lock links are pivotally mounted on the cradle pin 65 with one lock link on each side of the cradle 25 which is also pivoted on the pin 65. The modified lock links 109' also terminate in hook-like upper extensions 111'. In the center portion of the lock links 109' are arcuate slots 115 through which the toggle pins 103 on the cradle 25 extend. A positive off pin 117 extends between the lock links 109' thereby projecting into the planes of the upper toggle arms 99.

Under normal operation of the circuit breaker, the lock links 109' pivot about the cradle pin 65 in the clockwise direction as viewed in FIG. 7 under their own weight until the counterclockwise ends of the slots 115 are engaged by the toggle pin 103. When the handle 13 is moved to the off position and the toggle collapses, the lock links 109' rotate more clockwise as viewed in FIG. 7 so that the handle is free to move to the off position. Likewise, when the breaker trips and the toggle device collapses, the handle 13 can be moved to the reset position to relatch the cradle 25.

When the handle is moved to the on position, edges 117 to rotate the lock links 109' counterclockwise to the position shown in FIG. 7. If the contacts become welded closed, the toggle device remains in the erected position. If an attempt is made to move the handle to the off position, the projection formed by the positive off pin 117 engages the edges 119 of the upper toggle arms 99, thus preventing the lock links 109' from rotating clockwise in FIG. 7. With the lock links 109' held in the position shown in FIG. 7 by the upper toggle arms 99, the hook-like extensions 111' are placed in the path of the flange 87 on the web 77 of the yoke 73 to prevent the handle 13 from being moved to the off position. If the contacts are only lightly welded, force exerted on the handle in the off direction applies a moment to the upper toggle arms 99 which may be sufficient to break the weld.

The invention provides a positive mechanical interlock which prevents the handle from being moved, and more importantly, being locked in the off position when the contacts are welded closed. While the handle 13 can be moved partly toward the off position, it cannot reach the off position, and hence, the cradle cannot be relatched nor can the handle reach a position which would indicate that the contacts were open. Furthermore, once the handle is released, it will return to the on position to provide a visual indication of the condition of the contacts.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical circuit breaker comprising:

a housing; a fixed contact mounted within said housing; a movable contact mounted within said housing; said fixed contact being disposed for engaging said movable contact under predetermined conditions, a movable contact arm structure carrying said movable contact and being movable between open and closed positions to open and close said contacts, a latchable cradle, a trip device mechanically interconnected with said latchable cradle for latching said latchable cradle in a latched position and unlatching said latchable cradle in response to predetermined current overload conditions, a toggle device connected to said latchable cradle and said movable contact arm structure and being movable between an erected position which moves said movable contact arm structure to the closed position and a collapsed position which moves said movable contact arm structure to the open position, said toggle device remaining in the erected position when said contacts are welded closed; an operating member incorporating a handle; a spring means connected between said toggle device and said operating member, said spring means biasing said toggle device to the erected position to hold said contact arm structure in the closed position with said latchable cradle latched and said handle in an on position, said spring means biasing said toggle device to the collapsed position to move said contact arm structure to the open position when said handle is moved to an off position and when said latchable cradle is unlatched by said trip device, said spring means biasing said handle to a trip position intermediate said on and off positions when said latchable cradle is unlatched by said trip device and said movable contact arm structure is moved to the open position, said latchable cradle being relatched by movement of said handle beyond said off position, and including an interlock member engaging said toggle device and blocking movement of the handle to the off position when said contacts are welded closed and the toggle device remains erected;

said interlock member is pivoted about a pivot axis and has engagement means spaced from the pivot axis, said toggle device pivoting said interlock member about said pivot axis to position said engagement means to block movement of said handle to the off position when said contacts are welded closed; and a common pivot pin about which said latchable cradle pivots to latch and unlatch, and wherein said interlock member is also pivoted about said common pivot pin.

2. The circuit breaker of claim 1 wherein said interlock member comprises a pair of lock links straddling said cradle, and said engagement means comprise hook-like projections on said pair of lock links.

3. The circuit breaker of claim 2 wherein said operating member includes a yoke having a web joining a pair of spaced apart pivoted arms straddling said cradle and said pair of lock links, said hook-like projections on said pair of lock links engaging said web of said operating member to prevent movement of the handle to the off position when the contacts are welded closed.

4. The circuit breaker of claim 3 wherein said toggle device includes first and second pairs of toggle arms pivotally connected by a toggle spring pin about which said first and second pairs of toggle arms rotate between the erected and collapsed positions of said toggle device, said toggle spring pin bearing against and pivoting said lock links to position said hooks to block movement of said handle to the off position when said contacts are welded closed and said toggle device remains erected.

* * * * *